US005129344A

United States Patent [19]

Ono et al.

[11] Patent Number: 5,129,344

[45] Date of Patent: Jul. 14, 1992

[54] ACTUATING MECHANISM

[75] Inventors: Bryan K. Ono, Santa Monica; Thomas M. Sneddon, Panorama City, both of Calif.

[73] Assignee: Kransco, San Francisco, Calif.

[21] Appl. No.: 602,730

[22] Filed: Oct. 24, 1990

[51] Int. Cl.[5] ..... B63B 35/79; B63B 3/38; B63B 1/00; B63H 9/00

[52] U.S. Cl. ..... 114/132; 114/127; 114/39.2; 114/130; 114/140; 441/65; 441/79

[58] Field of Search ..... 114/132, 39.2, 130, 114/284, 127, 140, 141; 441/65, 79, 74

[56] References Cited

U.S. PATENT DOCUMENTS

| | | | |
|---|---|---|---|
| 3,066,327 | 8/1958 | Durfey | 9/310 |
| 3,082,444 | 12/1961 | Estes | 9/310 |
| 3,087,173 | 4/1963 | Meyer | 9/310 |
| 3,287,991 | 11/1966 | Eckert | 74/533 |
| 3,516,100 | 6/1970 | Ellis | 9/310 |
| 3,579,682 | 5/1971 | Wood | 9/310 |
| 3,902,441 | 9/1975 | Scholle | 114/39 |
| 4,398,485 | 8/1983 | Diziere | 114/132 |
| 4,439,166 | 3/1984 | Maxwell | 441/79 |
| 4,493,665 | 1/1985 | Liddle | 441/79 |
| 4,566,349 | 1/1986 | Van der Loon et al. | 74/475 |
| 4,708,675 | 11/1987 | Shoeffler et al. | 441/65 |
| 4,805,546 | 2/1989 | Geller et al. | 114/132 |
| 4,883,436 | 11/1989 | Oakland | 114/132 |

FOREIGN PATENT DOCUMENTS

| | | |
|---|---|---|
| 2659297 | 3/1978 | Fed. Rep. of Germany . |
| 2738070 | 3/1979 | Fed. Rep. of Germany . |
| 2828859 | 1/1980 | Fed. Rep. of Germany . |
| 3446844 | 7/1985 | Fed. Rep. of Germany . |
| 58-85789 | 5/1983 | Japan . |

*Primary Examiner*—Joseph F. Peters, Jr.
*Assistant Examiner*—Kenneth Lee
*Attorney, Agent, or Firm*—Kolisch, Hartwell, Dickinson, McCormack & Heuser

[57] ABSTRACT

An actuating mechanism is provided for controlling external devices by means of coaxial actuating cables or other suitable linkages. The actuator includes an internal slide element movable to selected detent positions by means of a lever arm which pushes against the slide when raised. The slide is returned to its starting position by depressing the lever arm. Indicator openings are provided in the body of the actuator permitting visual inspection of the position of the slide to indicate the control setting selected. Use of the actuator to control and position retractable fins or skegs on a water board is also disclosed. The actuator is positioned on the upper surface of the water board just forward of and between the rider's knees and coaxial actuating cables link the actuator to retractable fins on the underside of the board. The actuator can be easily manipulated with one hand to retract or extend the fins quickly. The indicator feature indicates the fin setting selected.

21 Claims, 4 Drawing Sheets

ACTUATING MECHANISM

BACKGROUND OF THE INVENTION

The invention relates generally to actuating mechanisms of the type which selectively control an external device and more particular to an actuating mechanism for controlling a remote device by means of one or more flexible coaxial cables. Use of the actuating mechanism to reposition retractable fins or skegs on a water board is also disclosed.

Actuating mechanisms are useful for remotely controlling, adjusting or imparting movement or force to other devices. Flexible coaxial actuating cables are often used in conjunction with actuators to accomplish such remote control. In a coaxial cable, relative movement is induced between the central actuating member or wire and the sheath, which is generally anchored to act as a fulcrum. An actuator or actuating mechanism is attached to one end of the cable and the controlled device is at the other end, remote from the actuator. The actuator induces relative movement between the central wire and the sheath and the controlled device responds to the relative motion. In some applications the controlled device is not visible to the person manipulating the actuator and some form of visual indication of the most recent setting is useful in controlling the remote device.

One remote control function conveniently accomplished by means of flexible actuating cable is in the setting and repositioning of physical control surfaces on water boards, such as retractable fins or skegs. Water boards are similar to surf boards and come in various sizes to accommodate riders kneeling, sitting or standing. Water boards are often towed behind a power boat with the rider kneeling and holding a tow line. Some water board maneuvers are best accomplished with fins or skegs extended on the underside of the board, to impart stability. At other times fins are not used or are undesirable, for example when the board is being towed up an incline for jumping or when performing various tricks such as spins or sliding sideways. Consequently, retractable fins have been developed and patented, for example, the system shown in U.S. Pat. No. 4,805,546. In that patent, the fins are manipulated by the rider reaching down beneath or behind his legs to change the settings from a kneeling position.

It would be more convenient to control the fins on the underside of a water board remotely from a location on top of the board, preferably forward of the rider's kneeling position. Such a system is shown in U.S. Pat. No. 4,883,436. While such a fin controller might be configured in numerous ways, the challenge is to provide both direct functionality and clear responsiveness with a minimum of complex manipulation. A water board rider holding a tow rope necessarily has only one hand free at any moment to reposition or retract the fins and the operation must be accomplished quickly. One disadvantage of the actuator shown in U.S. Pat. No. 4,883,436 is that, to adjust the fins, the rider must unscrew a control knob, reposition a sliding piece in a slot and re-tighten the knob. A preferable system would allow the rider to make necessary adjustments almost instantaneously. It would also be preferable to have information about the fin setting available at a glance.

It is an object of the present invention to provide an actuating mechanism for selectively positioning a movable element to control an external device in which the actuating mechanism is easy to manipulate with one hand and incorporates a single lever to act in one control direction when raised and in another, opposite control direction when depressed.

Another object of the invention is to provide an actuating mechanism of simple, rugged and effective design which incorporates a position indicator capable of providing visual indication of the physical position of the controlled device at a location adjacent the actuating mechanism.

SUMMARY OF THE INVENTION

Accordingly, an actuating mechanism is provided for selectively positioning a movable element in one of a plurality of selected positions to effect a control function. The mechanism comprises a body having a longitudinal axis. A slide member is movable longitudinally relative to the body to effect a control function. Releasable detent means permit the slide member to move in a first longitudinal direction to selected detent positions, the releasable detent means being biased into engagement with the slide member. And a lever arm rotatable about a pivot axis is provided on the body. The lever arm is rotatable from a rest position and is positioned to contact and push the slide member in the first longitudinal direction to a selected detent position when the lever arm is rotated in a first rotational direction. The lever arm also engages the detent means to release the detent means, permitting the slide member to move in a second longitudinal direction opposite the first longitudinal direction when the lever arm is rotated in a second rotational direction.

In its preferred form, the invention includes indicator openings in the exterior of the actuator body and indicator means on the slide element to provide visual indication of the location of the slide element relative to the actuator body. The location of the slide indicates the setting of the device controlled by the actuator. Suitable means for attaching one or more actuating linkages to the actuating mechanism are also disclosed. In another preferred embodiment, the actuator is incorporated into a water board to permit selective repositioning of one or more physical control surfaces on the water board, such as retractable fins or skegs.

DESCRIPTION OF THE PREFERRED EMBODIMENT

Figure 1:
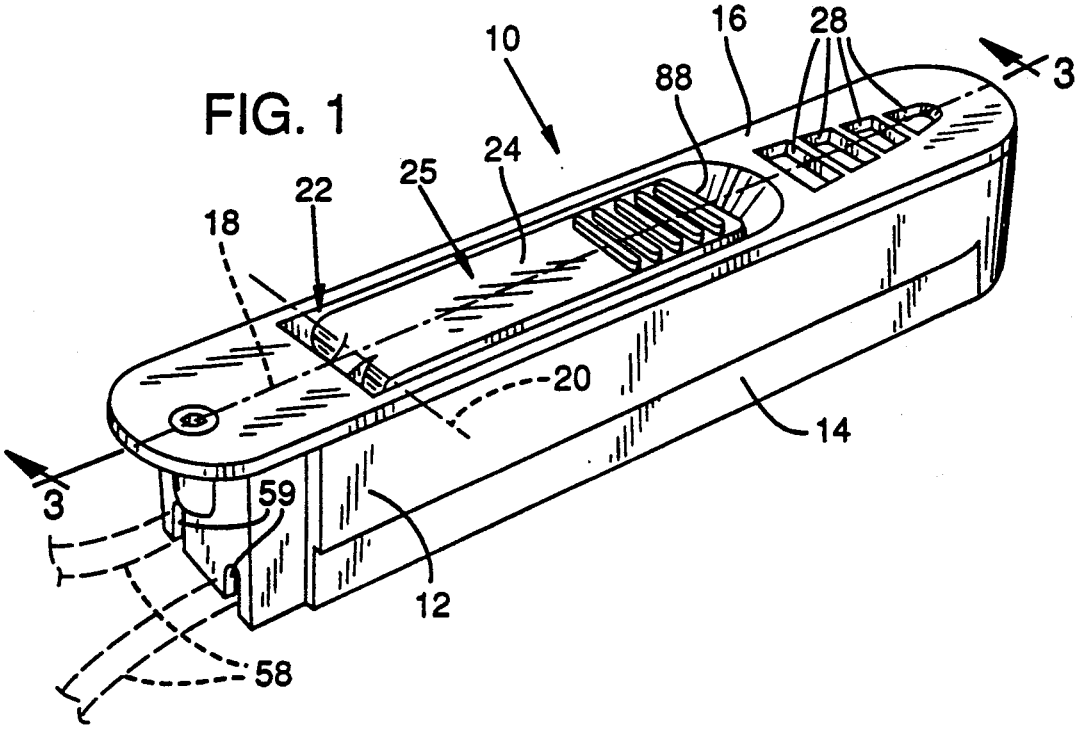
FIG. 1 is a perspective view of an actuating mechanism in accordance with the present invention.
Figure 2:
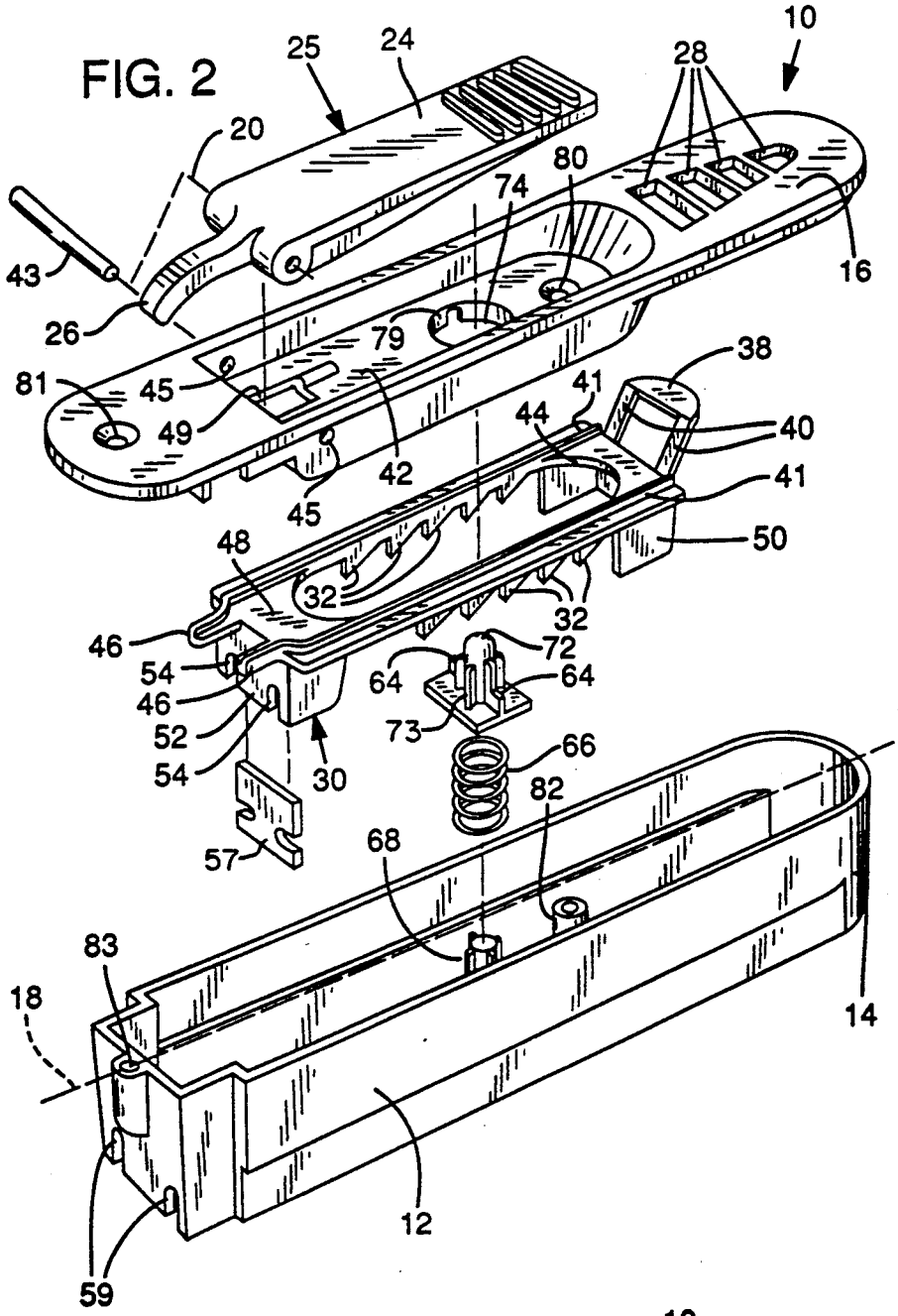
FIG. 2 is a partially exploded perspective view of the actuating mechanism of FIG. 1.

FIGS. 1 and 2 show, respectively, perspective and partially exploded views of the preferred embodiment of an actuator according to the present invention. With reference to FIGS. 1 and 2, actuator 10 includes a body 12 having two parts, a base 14 and a top 16. In its preferred form, body 12 is generally elongated, extending lengthwise in its longest dimension along either side of a central longitudinal axis 18. A pivot axis 20 extends through part of body 12, transverse to longitudinal axis 18 and generally perpendicular thereto. A hinge or pivot 22, which pivots about pivot axis 20, is incorporated into top portion 16 of body 12. Hinge 22 supports a lever arm 25, also referred to as lever means rotatable about pivot axis 20. Lever arm 25 includes an actuating arm portion 24 extending in one direction from hinge 22. The other part of lever arm 25, extending generally in the direction opposite to actuating arm 24, is a mover arm 26, extending from pivot axis 26.

Top 16 of body 12 includes indicator openings 28 formed in the body. Indicator openings 28 extend along longitudinal axis 18 of body 12 and constitute means forming openings through the exterior surface of the body to serve as position indicators for observing the position of a movable element within body 12, as described below.

A slide member 30 is disposed on the interior of body 12, between and enclosed by base 14 and top 16. Slide member 30, also referred to as a slide element, movable element or slide, is movable longitudinally relative to body 12 within the interior of the body. Longitudinal movement of slide element 30 is movement in a direction generally along or parallel to longitudinal axis 18. Slide element 30 is an elongate piece of molded plastic or another suitable material which is shorter in overall length than the length of body 12 along its longitudinal axis 18 to permit axial movement within the body. The width of slide element 30 is somewhat less than the interior width of the base 14, permitting free movement of the slide element in the fore and aft direction, generally along longitudinal axis 18. The movement of slide element 30 relative to body 12 is capable of effecting a control function by controlling the position of one or more external devices, as described below.

Figure 3:
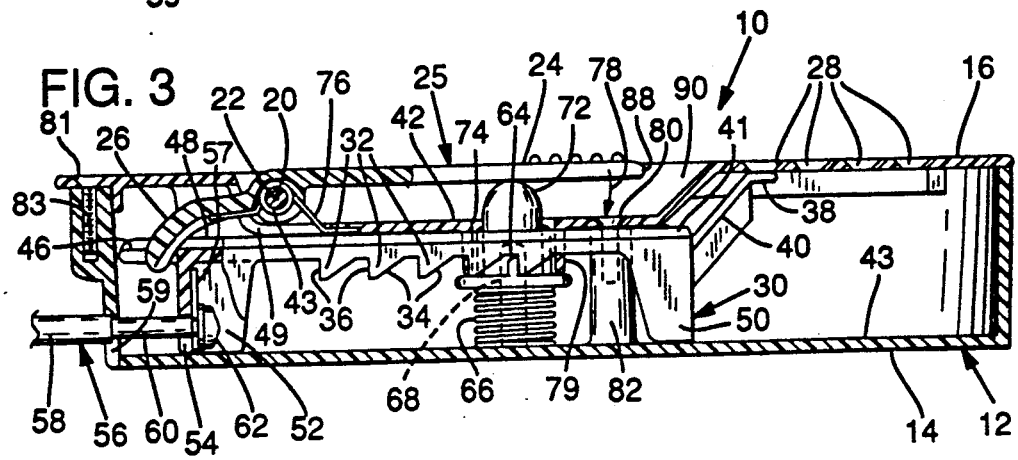
FIG. 3 is a side cross-sectional view of the actuating mechanism taken along line 3—3 of FIG. 1 with the lever arm in its rest position.

Referring to FIGS. 2 and 3, slide element 30 includes a double row of ratchet teeth attached to the slide element facing downwardly away from the top of body 12. Ratchet teeth 32 include inclined surfaces 34 and generally perpendicular surfaces 36. The inclined surfaces form part of the ratchet means to permit movement, when the ratchet is engaged, in one longitudinal direction and to prevent movement in the opposite direction. The ratchet teeth are part of a releasable detent means for permitting the slide to move to selected detent positions and for holding the slide in a selected detent position.

Slide element 30 further includes indicator means in the form of indicator bar 38, supported by a pair of supports 40 which serve as support means for the indicator bar. Indicator bar 38 is a portion of the slide element designed to be in registration with indicator openings 28 on the top 16 of body 12. When slide element 30 is at selected predetermined positions within and relative to body 12, indicator 38 appears and is visible through the indicator openings 28 in top 16, permitting visual inspection of that portion of the slide element in registration with the indicator openings. To assist in facilitating the indicator function and the visibility of indicator bar 38 through openings 28, it is suggested that indicator bar 38 or the entire slide element 30 be formed of a material having a highly visible color or surface finish which contrasts with the color or surface of body 12. In the preferred embodiment, body 12 is formed of black plastic and the entire slide element 30 is made of red plastic to increase its visibility through openings 28.

The top of actuator body 12 is contoured to include an elongated recess 42 extending generally along longitudinal axis 18. Actuating arm portion 24 of lever arm 25, when in its rest position shown in FIGS. 1 and 3, fits within recess 42 and overlies and extends generally longitudinally parallel to the exterior top surface of the body within recess 42. Lever 25 is attached to body 12 by hinge 22, which includes a pin or shaft 43, extending along pivot axis 20. Pin 43 is attached to or set into openings 45 in the walls of recess 42. Lever arm 25 is pivotable around pin 43. Alternatively, hinge 22 could be formed by shafts or pins fixed to lever arm 25 and extending into openings 45. Hinge 22 is located at one end of recess 42. Actuating arm 24 extends longitudinally within the recess. As shown in FIG. 3, the top surface of the actuating arm portion of the lever arm is approximately co-planar with the portion of the top surface of body 12 surrounding recess 42. The portion of the top surface of body 12 which forms the bottom of recess 42 is also called the first exterior surface of the body or the portion of the body which is overlain by lever arm 25.

In the preferred embodiment, slide element 30 is shaped to fit within body 12 in a cooperating relationship with top 16 and bottom 12. The slide element fits between the underside of recess 42, which extends downwardly from top 16 into the interior of body 12, and the interior lower surface 43 or floor within base 14. A pair of longitudinally-extending spacer ribs 41 extend along the top 48 of slide 30 to help position the slide below the underside of recess 42. Spacer ribs 41 help maintain sufficient space between the top 48 of slide 30 and the bottom of recess 42 to prevent said particles from wedging in between and to permit water to flush out such particles from between the underside of the recess and the slide. A large, elongated central opening 44 is formed in the top 48 of slide element 30 to permit its movement past parts of the actuator which extend upward within the body from floor 43, as described below. Ratchet teeth 32 are arranged on either side of opening 44, generally parallel with and offset from longitudinal axis 18 of the actuator.

A pair of guide bars 46 (FIG. 2) extend from the end of slide element 30 opposite the end on which indicator bar 38 is mounted. Guide bars 46 extend generally parallel with longitudinal axis 18 and are flared slightly outwardly from one another, or are curved at their distal ends, to help guide the mover arm portion 26 of lever 25 between the guide bars. The guide bars are spaced far enough apart to permit mover arm 26 to pass between the guide bars. Mover arm 26 extends into body 12 through an opening 49 in top 16 (see FIGS. 2, 3 and 8), where the mover arm extends between guide bars 46 and contacts and pushes against slide 30 when actuating arm 24 is raised.

A pair of downwardly extending skirts 50 and 52 extend from the top 48 of slide 30. Skirts 50 and 52 generally support and help position slide element 30 within body 12 and provide surfaces on which the slide element slides. First skirt 50 is at the end of the slide element on which indicator bar 38 is mounted and second skirt 52 is at the opposite end of the slide element, where guide bars 46 are mounted. Means are provided on second skirt 52 for connecting slide element 30 to one or more control linkages actuated by actuator 10. Linkages used for this purpose are preferably one or more flexible coaxial actuating cables which each include a cable sheath, generally fixed to the frame of the device to which actuator 10 is attached, and also to the actuator body 12, to serve as a fulcrum. Actuating cables 56 also include a central movable actuating member such as a wire. In the preferred embodiment, skirt 52 of slide element 30 includes a pair of slots 54 for engaging two beads 62 formed on the ends of the central movable actuating wires within each of two flexible coaxial actuating cables. Slots 54 serve as means for engaging the central actuating members of cables 56. A locking piece 57 (FIG. 2) interlocks with cable beads 62 and slots 54 to prevent detachment of the cable wires from slide 30. The cable sheaths are attached to body 12 by means of slots or openings 59 in bottom 14, which serve as cooperating anchors for the cable sheaths, whereby relative motion between slide 30 and body 12 is imparted to and operates the coaxial cables 56.

FIG. 3, which is a cross-sectional view of the actuator of FIGS. 1 and 2, taken generally along longitudinal axis 18, illustrates the interrelationship of the various parts of an assembled actuator. Referring to FIG. 3, slide element 30 is shown in its first position within body 12. Actuating arm 24 of lever means 25 is shown in its rest position, extending generally along longitudinal axis 18 and overlying a portion of the top 16 of body 12, within top recess 42. In the rest position, the top of actuating arm 24 is generally parallel with the upper surface of the body surrounding recess 42. Hinge 22, aligned with pivot axis 20, is disposed slightly below the upper surface of the body.

FIG. 3 also shows the remaining elements of the releasable detent ratchet means coupled to slide element 30, including a movable pawl 64 urged upwardly, as viewed in FIG. 3, against or into engagement with ratchet teeth 32 by a biasing means such as spring 66. Pawl 64 is movably supported on a support post 68 attached to the interior of body 12 on the floor 43 of base 14. Post 68 extends upwardly from base floor 43 toward body top 16 and toward the overlying actuating arm 24, when the arm is in its rest position. Support post 68 includes a plurality of ribs forming an X-shaped pattern which fit into a cooperatively-shaped opening in the underside of pawl 64 to help maintain the orientation of pawl 64 on post 68.

In the preferred embodiment, pawl 64 is formed integrally with a button 72, also referred to as pusher means coupled to pawl 64. Button 72 extends upwardly (as viewed in FIG. 3) through an opening 74 in top 16 of body 12 (see FIGS. 2–5). Opening 74 is located within recess 42, directly beneath actuating arm 24 when it is in its rest position (the position shown in FIG. 3). As such, opening 74 is in the portion of the body overlain by the actuator arm. Button 72 is urged toward the underside of the actuating arm by spring 66, which urges button 72 upwardly on support post 68 toward a portion of the actuating arm. Pawl 64, attached to button 72, serves as a catch means engageable with the notches or flat sides 36 of ratchet teeth 32 to hold the slide element at predetermined positions in the manner of a ratchet. Pawl 64 is in two parts, on opposite sides of button 72, to engage both sets of ratchet teeth simultaneously (see FIG. 2). The forward edges of pawl 64, facing toward the inclined sides 34 of ratchet teeth 32, are preferably beveled or rounded to more smoothly engage incline surfaces 34.

A spring 76 is mounted between lever arm pivot hinge 22 and body 12 to serve as a means for rotatably urging actuating arm 24 toward the body from its rest position, in the general direction of arrow 78. As such, when the actuating arm 24 is in its rest position, as shown in FIG. 3, the actuating arm is urged into contact with pawl button 72. Downward extending lips 79 on opening 74 (see FIG. 2) include slots into which the two parts of pawl 64, on opposite sides of button 72, fit when the button is not depressed. A plurality of ribs 73 (FIG. 2) surround button 72 to assist in positioning the button within opening 74 and to act as spacers between the sides of button 72 and lips 79, so that sand particles or the like will not bind button 72 within opening 74. Ribs 73 also provide sufficient open space between the button and body opening 74 to permit water to wash or flush sand particles from in between, thus assuring free movement of button 72. The distance button 72 extends upward through opening 74 is selected to make the top of actuating arm 24 approximately co-planar with the top of body 12 when the arm is in its rest position.

Top 16 is attached to bottom 14 by means of a screw or other fastener passing through an opening 80 in top 16 and into a cooperating post 82 formed in base 14 (see FIGS. 2–5). Screw receiving post 82 extends upwardly from the floor 43 of base 14. The attaching screw (not shown) and pawl button 72 extend through the central opening 44 (FIG. 2) of slide element 30 when actuator 10 is assembled. A second opening 81 through top 16 is in registration with a screw-receiving opening 83 formed on base 14 of body 12 to accommodate a second attaching screw.

Figure 3A:
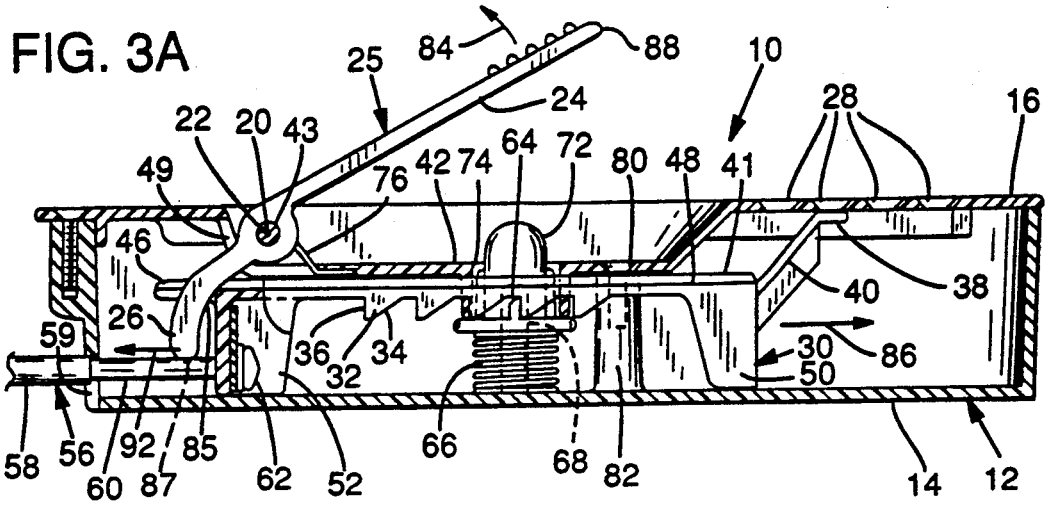
FIG. 3A is a side cross-sectional view as in FIG. 3 showing the actuating mechanism with the lever arm pivoted partially upwardly in a first rotational direction away from the body of the actuating mechanism.
Figure 4:
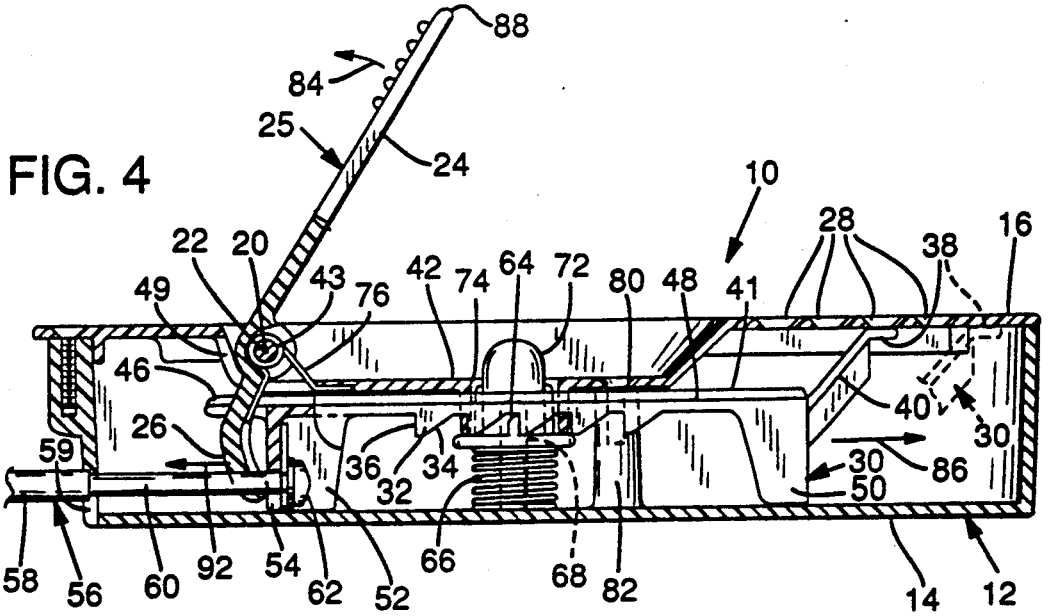
FIG. 4 is a side cross-sectional view as in FIGS. 3 and 3A showing the actuating mechanism with the lever arm rotated farther away from the body.
Figure 5:
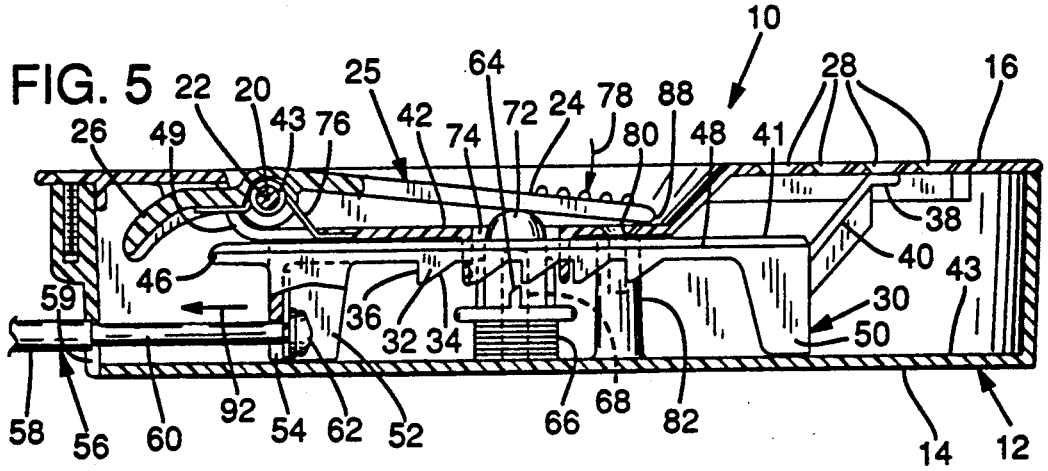
FIG. 5 is a side cross-sectional view as in FIG. 3 showing the lever arm rotated in a second rotational direction toward the body of the actuating mechanism.

Operation of the actuating mechanism of the present invention is illustrated in FIGS. 3A, 4 and 5, which are side cross-sectional views as in FIG. 3. Referring to FIG. 3A, actuating arm 24 is pivoted upwardly away from body 12 in a first rotational direction 84 to move slide element 30 in a first longitudinal direction indicated by arrow 86. Movement is accomplished by mover arm 26 of lever 25 engaging slide element 30 between guide members 46 (see FIG. 2) and pushing against the slide element as the actuating arm is raised.

FIG. 3A shows lever arm 25 in a partially raised position in which the mover arm 26 begins to contact and push slide 30. Mover arm 26 includes a camming surface 85 which contacts and slidingly pushes against slide member 30 as lever arm 25 is rotated in first rotational direction 84. Because of the shape of mover arm 26, camming surface 85 is the only surface of the lever arm contacting and pushing against slide 30 as the lever arm is initially raised in first rotational direction 84. As the lever arm is further rotated in the first rotational direction, as shown in FIG. 4, the distal end 87 of mover arm 26 contacts skirt 52 of slide 30 and takes over the pushing function. The curvature of pusher arm 26 and shape of camming surface 85 provide additional leverage to move slide 30 relatively slowly at the beginning of the upward travel of lever arm 25. The leverage exerted against slide 30 is gradually changed as the lever arm is raised, in order to smoothly exert the correct force against slide 30 throughout its range of movement. As such, lever arm 25 is relatively easy to raise as it is first lifted from its rest position and exerts increasing force against slide 30 as it is raised beyond the position shown in FIG. 4. A user will initiate upward movement of actuating arm 24 by inserting a finger underneath the distal end 88 of the actuating arm in the space 90 (FIGS. 3 and 8) between the actuating arm 24 and recess 42. Mover arm 26 thus serves as a means for moving the slide in first longitudinal direction 86 when actuating arm 24 is rotated away from body 12 in first rotational direction 84.

Movement of the slide in first longitudinal direction 86 causes inclined surfaces 34 of ratchet teeth 32 to engage, push against and depress pawl 64, driving the pawl and attached button 72 downwardly on support post 68 as each tooth passes over the pawl. That is because the inclined surfaces 34 of ratchet teeth 32 are oriented to permit slide 30 to move only in first longitudinal direction 86 when pawl 64 is engaged. As slide element 30 continues to move in first longitudinal direction 86, successive teeth 32 pass over pawl 64 in the fashion of a ratchet. The pawl prevents slide 30 from moving in the second longitudinal direction 92, opposite to first longitudinal direction 86.

A biasing force opposed to the force exerted by lever 25 will generally be applied to slide 30 for urging the slide in second longitudinal direction 92. Referred to as an opposed biasing force, the force exerted in direction 92 can be in the form of a spring within body 12 acting on slide element 30 or an external spring urging slide element 30 in direction 92 by way of actuating cables 56. Alternatively, the biasing force could be gravity, if the actuator was mounted vertically; hydraulic, if a suitable compression device is provided; or another suitable biasing method or device. In the preferred embodiment of the actuating mechanism, as used on a water board, the biasing force urging slide element 30 in second longitudinal direction 92 is provided by springs incorporated into the controlled retractable fins which are attached to the cables at the ends opposite to the actuator-cable connections.

The biasing force acting on slide element 30, serves as a means for urging the slide in second longitudinal direction 92 and for returning the slide to its first position (FIG. 3) when the ratchet pawl is released. Raising of lever actuating arm 24 exerts sufficient leverage on the slide element 30, via mover arm 26, to move it in first longitudinal direction 86 against the opposed biasing force acting in the second longitudinal direction, whether the force urging the slide in second direction 92 is internal to the actuator, applied through external linkages or through other means.

The limits of longitudinal movement of slide element 30 within body 12 extend from its first position, at the limit of travel within body 12 in direction 92, as shown in FIG. 3, to a second position at the limit of travel in direction 86, indicated partially in phantom in FIG. 4. When slide 30 is in the second position (phantom, FIG. 4) the leftmost teeth of ratchet 32 (as viewed in FIGS. 3–5) are engaged on pawl 64.

Slide element 30 can be selectively positioned in any of the detent positions established by ratchet teeth 32. Slide position is selected by raising actuating arm 24 the amount necessary to move slide 30 to the desired position. The more actuating arm 24 is raised or rotated from its rest position (shown in FIG. 3), the further mover arm 26 responsively pushes against and moves slide element 30 in first longitudinal direction 86. At the limit of its travel, lever 25 can be rotated until actuating arm 24 is slightly beyond vertical.

Ratchet teeth 32 and cooperating pawl 64 together serve as detents or as a releasable detent means for engaging and holding slide 30 in selectable predetermined positions relative to body 12. The selectable predetermined positions referred to are the detent positions of slide element 30 where pawl 64 engages the flat back side 36 of each pair of ratchet teeth, just after the teeth pass over the pawl. In the illustrative embodiment shown, there are five pairs of ratchet teeth 32 and thus five selectable predetermined detent positions to which slide element 30 can be selectively moved by lever 25, in addition to the first or starting position shown in FIG. 3. In each of the five detent positions, slide element 30 is held in place by pawl 64, against the urging of the biasing force acting in second longitudinal direction 92. Pawl 64 permits the slide member to move in first longitudinal direction 86 to selected ones of the detent positions.

The foregoing has described how slide element 30 is moved to a selected detent position in first longitudinal direction 86 from its first position. To return slide element 30 to its first position after it has been moved to a detent position, button 72 is depressed to release pawl 64 from engagement with the ratchet teeth 32. Releasing the pawl permits slide element 30 to freely move in second longitudinal direction 92 back to its first position. Button 72 serves as a pusher and acts as a pusher means coupled to pawl 64 for pushing and moving pawl 64 downwardly. In order to operate the detent release, button 72 is depressed with sufficient force to overcome the upward force of spring 66, thereby disengaging pawl 24 from ratchet teeth 32. As such, button 72 and pawl 64 together serve as a detent release or detent release means on body 12 to release the releasable detent means formed by ratchet teeth 32 and pawl 64.

Button 72, which lies beneath actuating arm 24, will normally be depressed by pressing actuating arm 24 toward body 12 from its rest position, rotating lever arm 25 in second rotational direction 78, as illustrated in FIG. 5. Depressing the actuating arm toward body 12 from its rest position will simultaneously contact and depress button 72 and attached pawl 64, disengaging the pawl from ratchet teeth 32. Once the pawl has been released from the ratchet teeth, the biasing force acting in second longitudinal direction 92 will cause slide element 30 to rapidly return to its first position shown in FIG. 3. In the preferred embodiment, slide element 30 is moved by the actuating cables 56 coupled to the slide element, which are externally biased to retract the central actuator 60 into sheath 58, in direction 92. In actual operation, the depressing of actuating arm 24 toward the actuator body will cause slide 30 and actuating cables 56 to snap back to their starting positions shown in FIG. 3.

The actuating mechanism of the present invention includes indicator means for indicating the position of slide element 30 as an aid to the user. The indicator function results from the cooperative placement of indicator openings 28 and indicator bar 38, which forms a part of slide 30. In the preferred embodiment, indicator openings 28 include a plurality of separate openings or "windows" through the top 16 of body 12, adjacent actuating arm 24, aligned generally with the longitudinal axis 18 of the actuator. Four indicator openings are shown in FIGS. 1-5 and 8 and can conveniently be made of varying sizes, as desired, to relate to the control function being preformed. Thus, the actuator is useful both to control an external device and to indicate the control position selected.

Indicator bar 38 is preferably attached to slide element 30 in such a way as to produce approximate registration between the indicator bar and each opening 28, when slide 30 is moved to each detent position determined by the ratchet teeth 32 and pawl 64. In the illustrated example, the openings 28 are arranged in a descending hierarchy of size. The largest opening is the leftmost, as viewed in FIGS. 1-5 and 8. Indicator bar 38 is in registration with the largest opening when slide 30 is in its first position (shown in FIG. 3). As slide 30 is moved in first longitudinal direction 86, indicator bar 38 moves into registration with successively smaller openings 28, as shown at various phantom positions in FIG. 8. When the slide reaches its second position (in phantom in FIG. 4 and at the rightmost position illustrated in FIG. 8) the indicator bar 38 is beyond the last (smallest) opening 28 and will not be visible.

Figure 6:
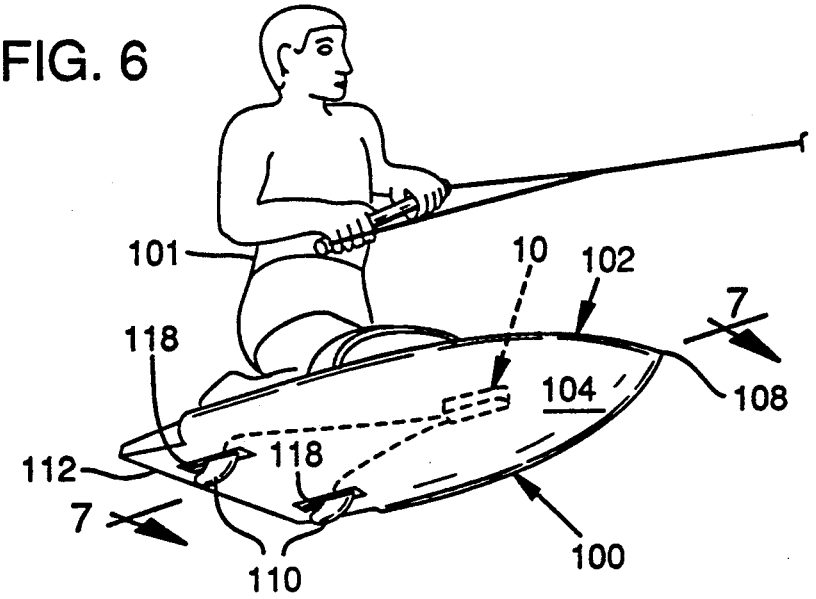
FIG. 6 is a perspective view of a water board incorporating a pair of retractable fins and illustrating the location of the actuating mechanism and control cables.
Figure 7:
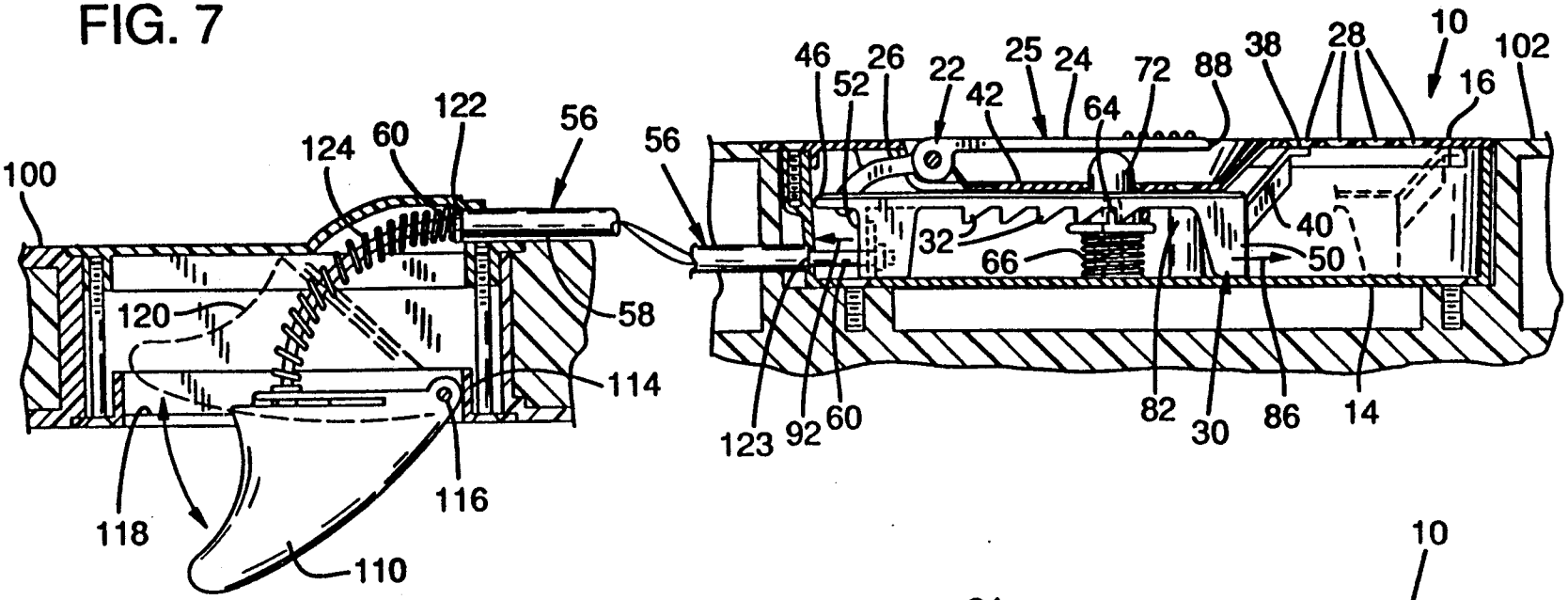
FIG. 7 is a side cross-sectional view of a part of the water board taken along line 7—7 of FIG. 6 showing the actuator and a retractable fin housing operatively coupled by a flexible, coaxial actuating cable.
Figure 8:
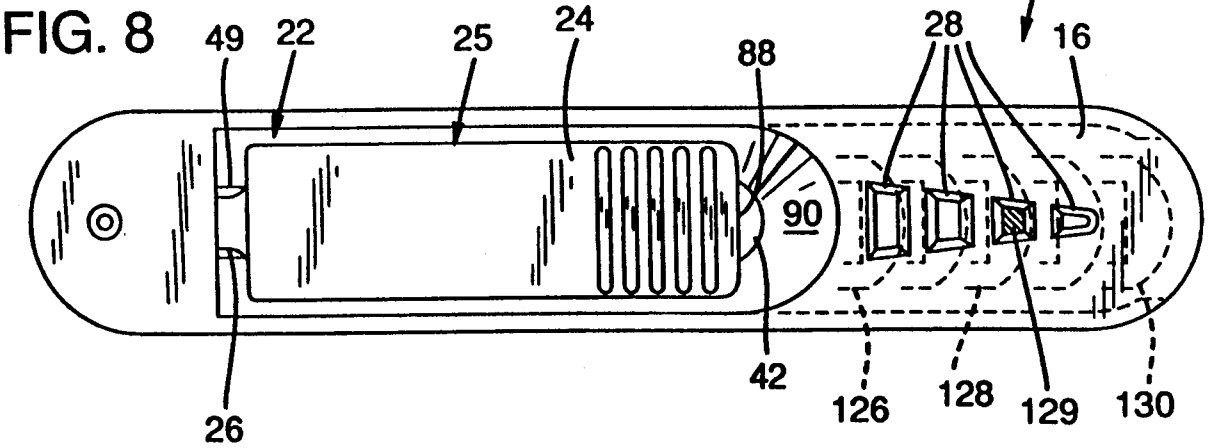
FIG. 8 is a top plan view of a portion of the actuating mechanism of FIG. 1, illustrating the indicator at selected positions.

FIGS. 6 and 7 illustrate how the actuator shown in FIGS. 1 through 5 is employed in controlling the position of retractable fins on the underside of a water board. Referring to FIG. 6, a water board 100 is shown in perspective from the underside with a kneeling rider 101 thereon. The water board 100 includes a top surface 102 on which a rider is supported, a bottom surface 104 opposite the top surface, and one or more physical control surfaces which can be repositioned by actuator 10 through one or more control linkages. In the illustrated embodiment, the physical control surfaces to be adjusted are a pair of fins or skegs 110 movable between extended and retracted positions. One of the fins is shown in detail in FIG. 7. FIGS. 6-8 are included to help illustrate an example of a control function for actuator 10.

Further defining the surfaces of water board 100, a rider 101, when kneeling or standing on the board, ordinarily faces the front 108 of the board. Retractable fins or skegs 110 are located on the bottom surface 104 near the rear 112 of the board. Referring to FIGS. 6 and 7, each fin 110 is mounted in a fin-receiving housing 114, which is embedded within the body of board 100. Illustrative fins 110 are mounted on a hinge or pivot 116 at the top forward or leading edge of the fin. A slot 118 is formed in the bottom of each fin-receiving housing 114, the slot being large enough to accommodate the fin as it is pivoted upward around hinge 116 in the manner shown in FIG. 7. Fins 110 are shaped to function in fully extended or partially retracted positions. The fully retracted position is shown in phantom at 120 in FIG. 7.

The position of each fin 110 is controlled by an actuator linkage in the form of a flexible coaxial actuating cable 56 coupled to the fin-receiving housing 114 in the manner illustrated in FIG. 7. The other or opposite end of each actuating cable is connected to actuator 10. Fins 110 are moved between extended and retracted positions by cables 56, which serve as control linkages. A spring 124 is provided within each fin-receiving housing 114 to urge the fin into the fully extended position shown with solid lines in FIG. 7. Spring 124 is compressed as the central movable actuating member 60 of each cable 56 is retracted into its sheath 58 at the fin end 122 and extends outwardly from sheath 58 at the actuator end 123. The force of spring 124 is transmitted to actuator 10 via cable 56, urging both the fins downwardly to the extended position and simultaneously urging slide 30 in direction 92. Spring 124 thus acts as the biasing force which must be overcome whenever slide 30 is moved in the first longitudinal direction 86.

FIGS. 6 and 7 illustrate in cross-section the interconnection between actuating mechanism 10 and the fins on water board 100. Actuator 10 is mounted on top surface 102 of the water board, located just forward of and between a rider's legs when kneeling on the board. If recesses or knee pockets (not shown) are provided on the board for the rider's knees, actuator 10 will most advantageously be placed on the raised contour between the knee pockets for convenient access by the rider. Actuating cables 56 extend from actuator 10 to the respective fins either on or through the body of the board.

Operation of the actuator and indicator of the present invention to control the position of fins 110 will be described with reference to FIGS. 3, 4, 5, 7 and 8. Starting with the actuator as shown in FIG. 3, actuator arm 24 being in its rest position and slide element 30 in its first position, fins 110 are fully extended as shown with solid lines in FIG. 7. The position of slide element 30 relative to body 12 is viewable through indicator opening 28. In the starting position, indicator bar 38 will be in registration with the first and largest indicator opening, at position 126 in FIG. 8.

If the rider on water board 100 desires to retract fins 110 to an intermediate or retracted position, he will raise actuator arm 124 in the manner shown in FIG. 4. That is accomplished by inserting a finger beneath actuator arm 24 and rotating it upward, causing mover arm 26 to push against and move slide element 30 to one of the intermediate detent positions determined by ratchet teeth 32 and pawl 64. As slide element 30 moves in response to the raising of actuating arm 24, indicator bar 38 will move to an intermediate position such as 128 in FIG. 8 (also shown in FIG. 4). When the desired intermediate position has been reached, the rider will release actuator arm 24, causing it to return to the rest position shown in FIG. 3. Slide element 30 will remain in the intermediate position shown in FIG. 4, held by pawl 64 engaging the ratchet teeth. FIG. 8 illustrates that indicator 38 of slide 30 can be viewed through the opening at 129. With the slide element in its middle position and indicator bar 38 at the position shown at 128 in FIG. 8, fins 110 are partially retracted.

To fully retract fins 110, the rider will again raise actuating arm 124, rotating it in the direction of arrow 84, as shown in FIG. 4, until slide element 30 has been moved all the way to its second position shown in phantom in FIG. 4. In that position, indicator bar 38 is at position 130 in FIG. 8. Indicator bar 38 is beyond the rightmost of the indicator openings 28 shown in FIG. 8 and will thus not be visible to the rider, providing an indication that the fins have been fully retracted. The fins are then positioned as shown in phantom at 120 in FIG. 7.

To change from having fully retracted fins to fully extended fins, the rider will push down on actuating arm 24 in the manner shown in FIG. 5, causing arm 24 to depress button 72 and disengage pawl 64 from ratchet teeth 32 on the slide element. That will release the slide element to return to its first position shown in FIG. 3. Motive force for causing slide element 30 to move back to its first position is provided by springs 124 (see FIG. 7), located in each fin housing. The biasing force is conveyed to slide element 30 through the actuating cables 56.

Whenever the water board rider wishes to change the position of fins 110, lever arm 25 is first depressed to disengage pawl 64 from ratchet teeth 32, causing the fins to go to their fully extended position, which serves as the starting position for all fin adjustments. The rider then raises lever arm 25 to set the fins in any desired intermediate or retracted position. Thus, the rider always knows where he is starting from (i.e., fully extended fins) before repositioning the fins, enabling the rider to quickly develop a "feel" for the actuator and its operation.

The actuator and indicator of the present invention provides a simple mechanism for effecting a control function by the manipulation of a single actuating arm. Lever arm 25 is positioned on the body of the actuator so that it can both contact and push the internal slide member 30 in first longitudinal direction 86 to a selected detent position when rotated in first rotational direction 84, and is also positioned to engage and release the detent means of the actuator and to permit the slide member to move in second longitudinal direction 92 when the lever arm is rotated in second rotational direction 78. A such, the single lever arm 25 is able to reposition one or more physical control surfaces on a water board simply by rotation of the single lever arm in one or the other rotational direction.

The actuator of the present invention offers the user a clear, instantaneous indication of the setting selected because the slide element within the actuator is viewable through indicator openings in the actuator body adjacent the actuating arm. The portion of the slide and the portion of the controlled surfaces on the water board are both indicated by the position of the slide relative to the indicator openings. Indicator openings of descending size help the user to visualize the settings being made, with the largest opening corresponding to the greatest, or most extended, fin setting and progressively smaller openings corresponding to decreasing fin size. In the final position no indicator is visible, corresponding to the absence of fins (i.e., full retraction).

The actuator is well suited to controlling the position of retractable fins or other physical control surfaces on a water board, allowing a rider to retract the fins to the extent desired and to instantaneously extend them again by pushing down on the actuator arm. The actuator is preferably fabricated of molded plastic material which is relatively inexpensive, waterproof, and can be made in contrasting colors to maximize the effectiveness of the indicator feature.

Alternative embodiments of the actuating mechanism are possible within the scope of the present invention. The preferred embodiment includes a slide element attached to two flexible actuating cables, although a single cable or three or more cables could alternatively be attached without changing the function of the actuator. The actuator shown and described makes use of the external biasing springs on the retractable fin mounts for urging the slide elements toward its first position An internal spring, within the body of the actuator, could alternatively accomplish the same biasing function. The indicator openings in the body of the actuator are in registration with a specifically devised indicator bar supported on the slide element to perform the indicator function. Alternatively, indicator openings could be provided which permit viewing of the slide element itself, rather than an indicator bar extending from the slide element. Indicator openings could be provided in the side walls of the housing, rather than on top, without changing the overall indicator function achieved by the invention. Pivoting hooks or other catch elements could be substituted for pawl 64 to provide the detent function. Other variations within the scope of the present invention will occur to the those skilled in the art.

The invention provides an actuating mechanism for selectively positioning a movable element to control an external device, the mechanism being easy to manipulate with one hand, incorporating a single lever to act in one control direction when raised and in another, opposite control direction when depressed. The invention provides an actuating mechanism which incorporates a position indicator of simple, rugged, and effective design capable of providing visual indication of the physical position of the controlled device at a location remote from the external device being controlled. The position indicator is provided adjacent the actuating arm of the mechanism.

What is claimed is:

1. An actuating mechanism for selectively positioning a movable element in one of a plurality of selected positions to effect a control function, comprising:

a body having a longitudinal axis, a lever arm on the body mounted for rotation about a pivot axis and movable in first and second rotational directions from a rest position, a slide member movable relative to the body in first and second opposed longitudinal directions to effect a control function, the lever arm being positioned to engage and push the slide member in the first longitudinal direction to a selected position relative to the body when the lever arm is rotated in the first rotational direction, releasable detent means for holding the slide member in the selected position to which it has been moved by the lever arm and for preventing return movement of the slide member in the second longitudinal direction when the lever arm is returned to its rest position, and the lever arm engaging the detent means to release the detent means when the lever arm is rotated in the second rotational direction from its rest position to permit the slide member to move in the second longitudinal direction.

2. An actuating mechanism as in claim 1 in which the releasable detent means includes ratchet teeth connected to the slide member and a pawl urged against the ratchet teeth by biasing means.

3. An actuating mechanism as in claim 2 in which the ratchet teeth have inclined surfaces oriented to permit the slide means to move only in the first longitudinal direction when the pawl is engaged.

4. An actuating mechanism as in claim 3 which a portion of the lever arm extends generally longitudinally parallel to an exterior surface of the body when the lever arm is in its rest position.

5. An actuating mechanism as in claim 1 including means for urging the slide member in the second longitudinal direction, the limit of travel of the slide member in the second longitudinal direction being a first position of the slide member, and in which the slide member moves to its first position when the detent means is released.

6. An actuating mechanism as in claim 1 in which the slide member is within and enclosed by the body and the body includes one or more indicator openings in the exterior thereof, a portion of the slide member being in registration with the one or more indicator openings, whereby visual inspection of the position of the slide member through the indicator openings indicates the position of the slide member relative to the body.

7. An actuating mechanism as in claim 1 in which the lever arm includes a mover arm extending from the pivot axis to contact and push the slide member when the lever arm is pivoted in the first rotational direction, the mover arm including a camming surface thereon which contacts and slidingly pushes against the slide member as the lever arm is rotated in the first rotational direction.

8. An actuator and indicator for selectively positioning a movable element to control an external device and to indicate the position selected, comprising:

a body having a longitudinal axis, the body including one or more indicator openings in the exterior thereof, a lever on the body rotatable about a pivot axis and including an actuating arm extending generally longitudinally parallel to an exterior surface of the body when in a rest position, a movable element within the body movable relative thereto in first and second opposed longitudinal directions to control an external device, a portion of the movable element being in registration with the one or more indicator openings to permit visual inspection of the position of the movable element, the lever further including a mover arm extending into the body for pushing against and moving the movable element in the first longitudinal direction when the actuating arm is rotated in a first rotational direction away from the body, detents for engaging and holding the movable element in selectable predetermined positions to which the movable element has been moved by the mover arm of the lever and for preventing return movement of the movable element in the second longitudinal direction when the actuating arm is returned to its rest position, and a detent release operable when the actuating arm is pressed toward the body from the rest position in a second rotational direction to release the detent holding the movable element, permitting the movable element to move in the second longitudinal direction.

9. An actuator and indicator as in claim 8 in which the detents include ratchet teeth on the movable element and a movable pawl urged into engagement with the ratchet teeth, the ratchet teeth having inclined surfaces oriented to permit the movable element to move only in the first longitudinal direction when the pawl is in engaged, the detent release including a pusher coupled to the pawl extending from the body toward the actuating arm, the pusher being urged toward the actuating arm by biasing means and the detent release being engaged by a portion of the actuating arm acting against the pusher when the actuating arm is pushed toward the body, thereby disengaging the pawl from the ratchet teeth.

10. An actuator and indicator as in claim 9 including means for rotatably urging the actuating arm around the pivot axis toward the body such that the actuating arm contacts the pusher when in its rest position.

11. An actuator and indicator as in claim 8 in which the one or more indicator openings in the body are positioned along the longitudinal axis of the body.

12. An actuator for repositioning one or more physical control surfaces on a water board, the control surfaces being adjustable by means of one or more control linkages, the actuator comprising:

a body attached to the water board, the body having a longitudinal axis, a slide element within the body movable longitudinally relative thereto in first and second opposed longitudinal directions, the slide element and the body being cooperatively coupled to one or more control linkages on the board whereby the relative position of the slide element determines the position of one or more physical control surfaces on the board, releasable detent means biased into engagement with the slide member for permitting the slide element to move in the first longitudinal direction to selected detent positions and for preventing return movement of the slide element in the second longitudinal direction until the detent means is released, and a lever arm on the body rotatable about a pivot axis from a rest position overlying a portion of the body, the lever arm being positioned to contact and push the slide member in the first longitudinal direction to a selected detent position when the lever arm is rotated in a first rotational direction away from the body, the lever arm being returnable to its rest position while the detent means holds the slide element in the selected detent position to which it has been moved by the lever arm, and the lever arm additionally being positioned to engage and release the detent means to permit the slide member to move in a second longitudinal direction opposite the first longitudinal direction when the lever arm is rotated in a second rotational direction toward the body, whereby the control surfaces are adjustable in one direction by rotating the lever arm in the first rotational direction and in the other direction by rotating the lever arm in the second rotational direction.

13. An actuator as in claim 12 in which the releasable detent means includes ratchet teeth on the slide means and a movable pawl urged into engagement with the ratchet teeth by biasing means, the ratchet teeth having inclined surfaces oriented to permit the slide means to move only in the first longitudinal direction when the pawl is engaged, the detent means being releasable by means of a pusher coupled to the pawl extending through an opening in the body toward the lever arm, the pusher being urged toward the lever arm by biasing means such that when the lever arm is rotated in the second rotational direction toward the body from the rest position it contacts and depresses the pusher to disengage the pawl from the ratchet teeth.

14. An actuator as in claim 13 in which the pusher is slidably mounted on a support post attached to the interior of the body, the biasing means urging the pusher upward on the post.

15. An actuator as in claim 12 in which the one or more control linkages on the water board each include a flexible coaxial actuating cable employing a cable sheath surrounding a central movable actuating member, the slide element including slots therein for engaging the one or more movable actuating members and the body including cooperating anchors for the cable sheathes such that relative movement between the slide element and the body operates the one or more coaxial actuating cables.

16. An actuator for repositioning one or more physical control surfaces on a water board having a top surface on which a rider is supported and a bottom surface opposite the top surface, and one or more physical control surfaces including a pair of fins mounted within slots on the bottom surface of the water board which are between extended and retracted positions by means of one or more control linkages, the actuator comprising:

a body attached to the top surface of the water board, the body having a longitudinal axis, a slide element within the body movable longitudinally thereto, the slide element and body being connected to the one or more control linkages on the water board and cooperating therewith to retract the fins into their respective slots when the slide element is moved in a first longitudinal direction, the position of the slide element relative to the body determining the position of the fins within their respective slots, releasable detent means biased into engagement with the slide element for permitting the slide element to move in the first longitudinal direction to selected detent positions, and a lever arm on the body rotatable about a pivot axis from a rest position overlying a portion of the body, the lever arm being positioned to contact and push the slide member in the first longitudinal direction to a selected detent position when the lever arm is rotated in a first rotational direction away from the body to select the degree to which the fins are retracted into their respective slots, the lever arm being further positioned to engage and release the detent means to permit the slide member to move in a second longitudinal direction opposite the first longitudinal direction when the lever arm is rotated in a second rotational direction toward the body, permitting the fins to move to their fully extended positions when the lever arm is rotated in the second rotational direction.

17. An actuator and indicator for selectively repositioning one or more physical control surfaces on a water board and for indicating the positions selected, the control surfaces being adjustable by means of one or more control linkages, the actuator and indicator comprising:

a body attached to the water board, the body having a longitudinal axis and one or more indicator openings in the exterior thereof, a lever rotatably mounted adjacent a first exterior surface of the body including an actuating arm extending generally longitudinally parallel to and overlying the first exterior surface when in a rest position, a slide interior of the body movable longitudinally in first and second opposed longitudinal directions relative thereto, the slide being coupled to one or more control linkages for adjusting physical control surfaces on the water board, a portion of the slide being in registration with the one or more indicator openings in the body, the lever further including a mover arm extending into the body for moving the slide in the first longitudinal direction when the actuating arm is rotated in a first rotational direction away from the body, detents for engaging and holding the slide in selectable predetermined positions to which the slide has been moved by rotation of the lever arm in the first rotational direction and for preventing return movement of the slide in the second longitudinal direction when the lever is returned to its rest position, and a detent release operable when the lever is rotated in a second rotational direction toward the first exterior surface from the rest position to release the selected detent, permitting the slide to move in the second longitudinal direction, whereby the position of the slide and the position of the one or more physical control surfaces on the water board controlled thereby is indicated by the position of the slide relative to the one or more indicator openings.

18. An actuator as in claim 17 in which the detents include ratchet teeth on the slide and a movable pawl urged into engagement with the ratchet teeth by biasing means, the ratchet teeth having inclined surfaces oriented to permit the slide to move only in the first longitudinal direction when the pawl is engaged, the detent release including a pusher extending through an opening in the first exterior surface of the body toward the overlying actuating arm, the pusher being urged toward the actuating arm by the biasing means such that when the actuating arm is rotated toward the body in the second rotational direction from the rest position it contacts and depresses the pusher means overcoming the biasing means to disengage the pawl from the ratchet teeth.

19. An actuator as in claim 18 in which the pusher is slidably mounted on a support post attached to the interior of the body, the biasing means urging the pusher upward on the post.

20. An actuator as in claim 17 in which the water board has a top surface on which a rider is supported, a bottom surface opposite the top surface, the one or more physical control surfaces repositioned by the actuator includes a pair of fins mounted within slots on the bottom surface of the water board, the fins being movable between extended and retracted positions by means of control linkages, and in which the actuator is mounted on the top surface of the water board, the slide being connected to the control linkages for moving the pair of fins and the slide to retract the fins into their respective slots when the slide is moved in the first longitudinal direction.

21. An actuator and indicator as in claim 17 in which the one or more indicator openings in the body are positioned along the longitudinal axis thereof.

* * * * *